US006944930B2

(12) United States Patent
Asao et al.

(10) Patent No.: US 6,944,930 B2
(45) Date of Patent: Sep. 20, 2005

(54) METHOD FOR MANUFACTURING LOW-OXYGEN COPPER

(75) Inventors: Haruhiko Asao, Tokyo (JP); Yutaka Koshiba, Tokyo (JP); Keiji Nogami, Tokyo (JP); Tutomu Masui, Osaka (JP); Kazumasa Hori, Osaka (JP); Kenji Wakiguchi, Osaka (JP); Masahiko Wada, Osaka (JP); Yoshiaki Hattori, Osaka (JP)

(73) Assignee: Mitsubishi Materials Corporation, Tokyo (JP)

( * ) Notice: Subject to any disclaimer, the term of this patent is extended or adjusted under 35 U.S.C. 154(b) by 6 days.

(21) Appl. No.: 09/791,767

(22) Filed: Feb. 26, 2001

(65) Prior Publication Data

US 2001/0029659 A1 Oct. 18, 2001

(30) Foreign Application Priority Data

| | | |
|---|---|---|
| Feb. 24, 2000 | (JP) | 2000-48005 |
| Apr. 11, 2000 | (JP) | 2000-109827 |
| Apr. 11, 2000 | (JP) | 2000-109828 |
| Jul. 7, 2000 | (JP) | 2000-207488 |
| Jul. 7, 2000 | (JP) | 2000-207490 |
| Nov. 22, 2000 | (JP) | 2000-356325 |
| Nov. 22, 2000 | (JP) | 2000-356326 |

(51) Int. Cl.[7] ..... B23P 17/00; B22D 11/126

(52) U.S. Cl. ..... 29/527.6; 29/527.5; 29/DIG. 5; 266/197; 266/217; 266/231; 75/648; 75/649; 75/650; 75/653

(58) Field of Search ..... 29/527.5, 527.6, 29/527.7, 825, 33 C, DIG. 5; 266/231, 217, 197; 75/653, 649, 646, 647, 10.69; 164/460

(56) References Cited

U.S. PATENT DOCUMENTS 2,302,999 A * 11/1942 O'Brien 2,543,420 A * 2/1951 Ogg (Continued)

FOREIGN PATENT DOCUMENTS

| | | |
|---|---|---|
| GB | 1 439 004 | 6/1976 |
| GB | 1439004 | 6/1976 |

(Continued)

OTHER PUBLICATIONS

U.S. Appl. No. 09/832,191, filed Apr. 11, 2001.*

U.S. Appl. No. 09/423,456, filed Nov. 8. 1999.*

JPO Machine Translation of JP 06–212300.*

Patent Abstracts of Japan, JP 06 212300, Aug. 2, 1994.

*Primary Examiner*—Eric Compton
(74) *Attorney, Agent, or Firm*—Oblon, Spivak, McClelland, Maier & Neustadt, P.C.

(57) ABSTRACT

A method for manufacturing a low-oxygen copper wire is provided, in which a dehydrogenating treatment can be performed without requiring a long moving distance of molten copper, and the generation of holes in solidification is suppressed, whereby high quality low-oxygen copper wire can be obtained having superior surface quality. The method for continuously manufacturing ingots of low-oxygen copper from molten copper includes a step of performing combustion in a reducing atmosphere in a melting furnace so as to produce molten copper; a step of sealing the molten copper in a non-oxidizing atmosphere in a casting trough; a step of transferring the molten copper to a turn-dish by using the casting trough; a degassing step of passing the molten copper through a degasser provided in the casting trough so as to dehydrogenate the molten copper; a step of continuously feeding the molten copper to a continuous casting machine so as to continuously produce cast copper; and a step of cutting the cast copper into a predetermined length.

6 Claims, 8 Drawing Sheets

U.S. PATENT DOCUMENTS

| | | | | | |
|---|---|---|---|---|---|
| 2,859,262 | A | * | 11/1958 | Harders et al. | 373/26 |
| 3,490,897 | A | * | 1/1970 | Carey et al. | 75/650 |
| 3,525,510 | A | * | 8/1970 | Richardson | 266/208 |
| 3,528,803 | A | * | 9/1970 | Ichikawa et al. | |
| 3,607,231 | A | * | 9/1971 | Hart | |
| 4,186,791 | A | * | 2/1980 | Sladkoshteev et al. | 164/475 |
| 4,277,281 | A | | 7/1981 | Weber et al. | |
| 4,390,364 | A | | 6/1983 | Yu | |
| 5,037,471 | A | | 8/1991 | Iwamura et al. | |
| 5,143,355 | A | | 9/1992 | Iwamura et al. | |
| 5,656,236 | A | * | 8/1997 | Waite et al. | 266/225 |
| 5,733,500 | A | | 3/1998 | Meseha et al. | |

FOREIGN PATENT DOCUMENTS

| | | | |
|---|---|---|---|
| GB | 2041411 | * | 9/1980 |
| GB | 2048954 | | 12/1980 |
| GB | 2 048 954 | | 12/1980 |
| JP | 55-092259 | | 7/1980 |
| JP | 55-126353 | | 9/1980 |
| JP | 60-174240 | | 9/1985 |
| JP | 61-009510 | * | 1/1986 |
| JP | 02-141540 | | 5/1990 |
| JP | 04-099235 | * | 3/1992 |
| JP | 04-099236 | * | 3/1992 |
| JP | 04-099239 | * | 3/1992 |
| JP | 06-122929 | * | 5/1994 |
| JP | 06-228680 | | 8/1994 |
| JP | 7-254604 | | 10/1995 |
| JP | 10-156529 | | 6/1998 |
| JP | 11-000757 | * | 1/1999 |
| JP | 11-213777 | | 8/1999 |
| WO | WO 83/00508 | | 2/1983 |
| WO | WO 9742360 | | 11/1997 |
| WO | 97/42360 | * | 11/1997 |

* cited by examiner

METHOD FOR MANUFACTURING LOW-OXYGEN COPPER

CROSS REFERENCE TO RELATED APPLICATIONS

The present application is based on Japanese Application 2000-109827, filed on Apr. 11, 2000, which is hereby incorporated by reference in its entirety.

BACKGROUND OF THE INVENTION

1. Field of the Invention

The present invention relates to methods for continuously manufacturing low-oxygen copper, containing a suppressed level of oxygen content, by continuously casting molten copper produced in a melting furnace.

2. Description of the Related Art

Low-oxygen copper (called "oxygen-free copper" in some cases) in which the content of oxygen is controlled to 20 ppm or less, and more preferably, to 1 to 10 ppm, is widely used for producing various shapes, e.g., ingot forms such as billets and cakes, rolled sheets, wires and cut forms. As a method for manufacturing low-oxygen copper, a method is typically used in which molten copper is produced in a high-frequency furnace such as a channel furnace or a coreless furnace, the molten copper is transferred to a continuous casting machine while held in an airtight atmosphere and the casting is then performed.

When low-oxygen copper is produced by using a high-frequency furnace as described above, there are advantages in that a higher temperature can be easily obtained by a simple operation, and the qualities of the products are very uniform since no chemical reaction occurs in production of the molten copper. However, there are disadvantages in that the construction cost and the operating cost are high, and productivity is low.

In order to perform mass production of low-oxygen copper at lower cost, a method using a gas furnace such as a shaft kiln is preferably employed. However, when such a gas furnace is used, since combustion is performed in the furnace, i.e., oxidation occurs, the oxidized molten copper must be processed by a reducing treatment. This is the disadvantage of the gas furnace, which is not observed when a high-frequency furnace is used. As a result, low-oxygen copper cannot be produced unless oxygen contained in the molten copper is decreased by using a reducing gas and/or an inert gas in a step of transferring the molten copper before the molten copper is fed to a continuous casting machine.

In addition, even when the deoxidizing step described above is performed, holes will be formed in the low-oxygen copper and may result in generating defects such as blisters in some cases. As a result, the quality of the low-oxygen copper is degraded. In particular, when copper wire is manufactured, the holes described above will cause defects in a rolling step, and hence the copper wire has poor surface qualities. Accordingly, in general, it is believed that production of high quality low-oxide copper is difficult to perform using a gas furnace, and hence most of low-oxide copper is produced using a high-frequency furnace.

The holes described above are formed by bubbles of steam ($H_2O$) produced by combination of hydrogen and oxygen due to the decease in solubility of the gases in the molten copper when it is solidified. The bubbles are trapped in the molten copper during cooling and solidification and remain in the low-oxide copper, and hence holes are generated. From a thermodynamic point of view, the concentrations of hydrogen and oxygen in molten copper can be represented by the equation shown below.

$$[H]^2[O]=p_{H^2O}\cdot K \qquad \text{Equation (A)}$$

In the equation (A), [H] represents the concentration of hydrogen in molten copper, [O] represents the concentration of oxygen in molten copper, $p_{H^2O}$ represents a partial pressure of steam in the ambience, and K represents an equilibrium constant.

Since the equilibrium constant K is a function of temperature and is constant at a constant temperature, the concentration of oxygen in molten copper is inversely proportional to the concentration of hydrogen. Accordingly, in accordance with the equation (A), the concentration of hydrogen is increased by performing a deoxidizing treatment by reduction, and as a result, holes are easily generated during solidification, whereby only an ingot of low-oxygen copper having poor quality can be manufactured.

On the other hand, molten copper containing hydrogen at a low concentration can be obtained by melting copper in a state near complete combustion using an oxidation-reduction method, which is a general degassing method. However, in a subsequent deoxidizing step, a long moving distance of the molten copper is required, and hence the method described above cannot be practically used.

SUMMARY OF THE INVENTION

In consideration of the problems described above, an object of the present invention is to provide a method for manufacturing low-oxide copper, in which a dehydrogenating treatment can be performed without requiring a long moving distance of molten copper, in which the generation of holes in solidification is suppressed, and in which high quality low-oxide copper having superior surface quality can be obtained.

A method for continuously manufacturing ingots of low-oxygen copper from molten copper according to the present invention includes preparing a starting material for low-oxygen copper; performing combustion of the starting material in a reducing atmosphere in a melting furnace so as to produce molten copper; sealing the molten copper in non-oxidizing atmosphere in a casting trough; transferring the molten copper to a tundish by using the casting trough; passing the molten copper through a degasser provided in the casting trough so as to dehydrogenate the molten copper in a degassing step; feeding the molten copper to a continuous casting machine so as to continuously produce cast copper; and a step of cutting the cast copper into the ingots of low-oxygen copper each having a predetermined length.

In the method described above according to the present invention, the dehydrogenation in the degassing step is performed by stirring the molten copper.

In addition, in the method described above according to the present invention, the stirring in the degassing step is performed by passing the molten copper through a meandering flow path.

A method for continuously manufacturing a low-oxygen copper wire according to the present invention includes preparing a starting material for low-oxygen copper; performing combustion of the starting material in a reducing atmosphere in a melting furnace so as to produce molten copper; sealing the molten copper in a non-oxidizing atmosphere in a casting trough; transferring the molten copper to a tundish by using the casting trough; passing the molten copper through a degasser provided in the casting trough so as to dehydrogenate the molten copper in a degassing step; feeding the molten copper to a continuous casting machine so as to continuously produce cast copper; and rolling the cast copper so as to manufacture the low-oxygen copper wire.

In the method for continuously manufacturing the low-oxygen copper wire, the dehydrogenation in the degassing step is performed by stirring the molten copper.

In addition, in the method for continuously manufacturing the low-oxygen copper wire, the stirring in the degassing step is performed by passing the molten copper through a meandering flow path.

A method for continuously manufacturing a wire composed of a low-oxygen copper alloy of the present invention includes preparing a starting material for low-oxygen copper; performing combustion of the starting material in a reducing atmosphere in a melting furnace so as to produce molten copper; sealing the molten copper in a non-oxidizing atmosphere in a casting trough; transferring the molten copper to a tundish by using the casing trough; passing the molten copper through a degasser provided in the casting trough so as to dehydrogenate the molten copper in a degassing step; adding silver to the dehydrogenated molten copper; feeding the molten copper to a continuous casting machine so as to continuously produce a cast copper alloy; and rolling the cast copper alloy so manufacture the wire composed of the low-oxygen copper alloy.

In the method for continuously manufacturing the wire composed of the low-oxygen copper alloy, the dehydrogenation in the degassing step is performed by stirring the molten copper.

In addition, in the method for continuously manufacturing the wire composed of the low-oxygen copper alloy, the stirring in the degassing step is performed by passing the molten copper through a meandering flow path.

A method for continuously manufacturing a base low-oxygen copper material containing phosphorus for use in copper plating of the present invention includes preparing a starting material for low-oxygen copper; performing combustion of the starting material in a reducing atmosphere in a melting furnace so as to produce molten copper; sealing the molten copper in a non-oxidizing atmosphere in a casting trough; transferring the molten copper to a tundish by using the casting trough; passing the molten copper through a degasser provided in the casting trough so as to dehydrogenate the molten copper in a degassing step; adding phosphorus to the dehydrogenated molten copper; feeding the molten copper a continuous casting machine so as to continuously produce a cast base copper material; and rolling the cast base copper material so as to manufacture the base low-oxygen copper material containing phosphorus for use in copper plating. step of passing the molten copper through a degasser provided in the casting trough so as to dehydrogenate the molten copper; a step of adding phosphorus to the dehydrogenated molten copper; a step of feeding the molten copper to a belt caster type continuous casting machine so as to continuously produce a cast base copper material; and a rolling step of rolling the cast base copper material so as to manufacture the base low-oxygen copper material containing phosphorus for use in copper plating.

In the method for continuously manufacturing the base low-oxygen copper containing phosphorus, the dehydrogenation in the degassing step is performed by stirring the molten copper.

In the method for continuously manufacturing the base low-oxygen copper containing phosphorus described above, the stirring in the degassing step is performed by passing the molten copper through a meandering flow path.

The method for manufacturing the base low-oxygen copper material of the present invention further includes cutting the base low-oxygen copper material containing phosphorus obtained in the rolling step so as to continuously manufacture short base low-oxygen copper materials containing phosphorus for use in copper plating.

The method for manufacturing the base low-oxygen copper material containing phosphorus of the present invention further includes a step of washing the short base low-oxygen copper material containing phosphorus for use in copper plating.

In the methods for manufacturing the low-oxygen copper described above, the combustion is performed in a reducing atmosphere in a melting furnace, and hence the molten copper is deoxidized. The deoxidized copper is sealed in a non-oxidizing atmosphere in the casting trough and is then transferred to the tundish. Since the concentration of oxygen is inversely proportional to the concentration of hydrogen as described above, the concentration of hydrogen in the molten copper deoxidized in the melting furnace is increased. When the molten copper passes through the casting trough, containing hydrogen at a high concentration, the dehydrogenation is performed by the degasser. Accordingly, the amount of gas evolved in casting is decreased, the generation of holes in a cast copper is suppressed, and as a result the defects on the surface of the low-oxygen copper are reduced.

In addition, when the molten copper is stirred in the degassing step, the hydrogen contained in the molten copper is forced out therefrom, whereby dehydrogenation can be performed. That is, since a copper stirrer is provided in the casting trough, the molten copper contacted by the stirrer is stirred before it reaches the tundish, and as a result the molten copper is brought into good contact with an inert gas blown to the casting trough for forming a non-oxidizing atmosphere. In the step described above, since a partial pressure of hydrogen in the inert gas is very low compared to that in the molten copper, the hydrogen in the molten copper is absorbed in the non-oxidizing atmosphere formed by the inert gas, hereby the dehydrogenation of the molten copper can be performed.

Furthermore, when a dike is provided in the casting trough at which the molten copper passes, the molten copper flows meanderingly in the degassing step, and is stirred by the vigorous flow thereof. That is, the molten copper can be automatically stirred by the flow thereof. As described above, since the molten copper vigorously flows up and down, and right to left, the molten copper passing through the casting trough has good opportunity to be brought into contact with the inert gas, and as a result the efficiency of the degassing treatment can be further increased.

In the case described above, the dike provided in the flow path for the molten copper is preferably in the form of a bar, a plate or the like. In addition, a plurality of dikes may be provided along the flow direction of the molten copper or in the direction perpendicular thereto. Furthermore, when dikes are formed of, for example, carbon, the deoxidizing treatment can also be performed efficiently due to the contact between the molten copper and the carbon.

DESCRIPTION OF THE PREFERRED EMBODIMENTS

Hereinafter, the embodiments of methods for manufacturing low-oxygen copper according to the present invention will be described in detail with reference to the figures. In the embodiments described below, "low-oxygen copper" means copper or an alloy thereof containing oxygen at a concentration of 20 ppm or less, and preferably, of 1 to 10 ppm.

First Embodiment

A first embodiment will first be described with reference to FIGS. 1, 2A, and 2B. This embodiment relates to a method for manufacturing an ingot of low-oxygen copper.

Figure 1:
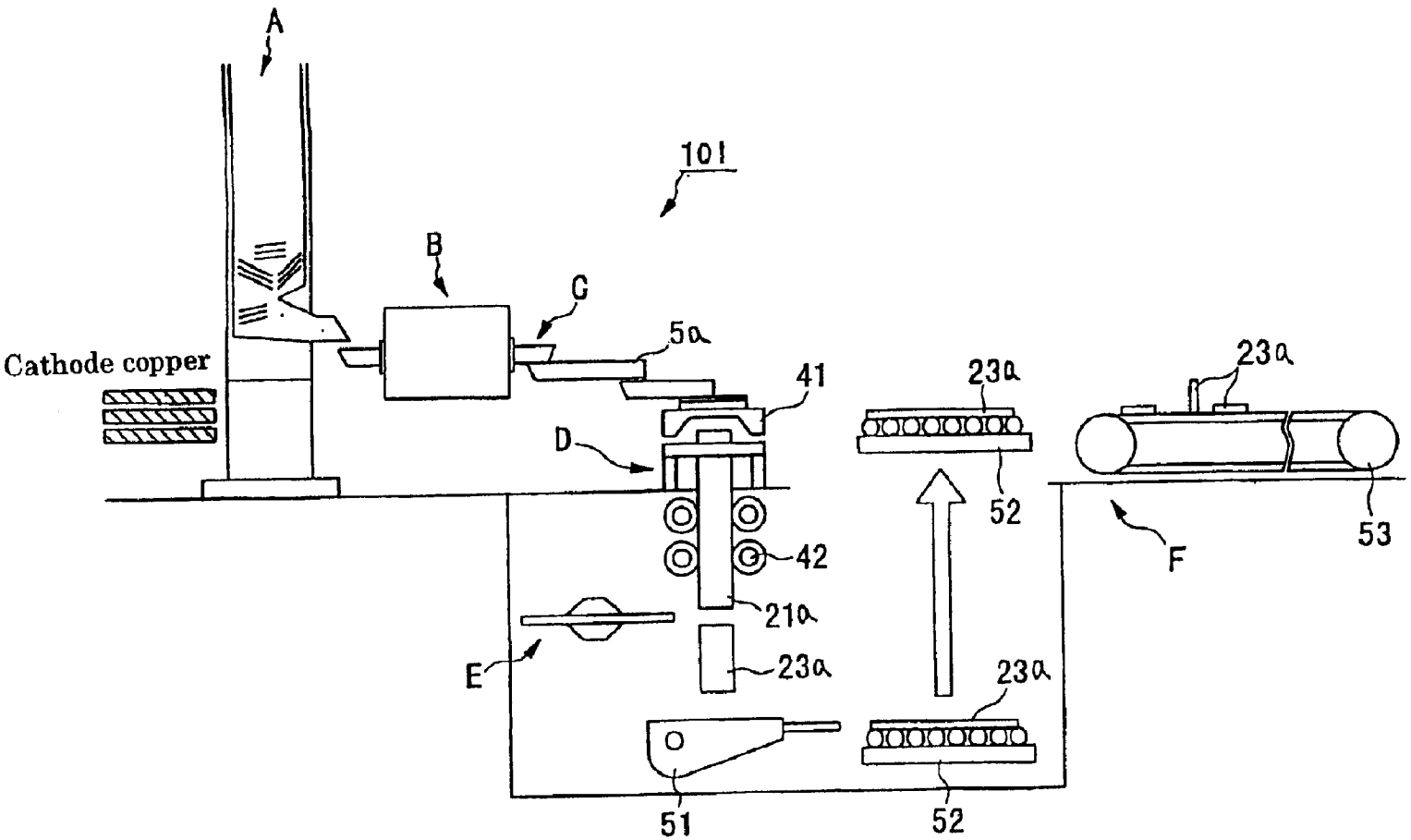
FIG. 1 is a schematic view showing the structure of an apparatus for manufacturing an ingot of low-oxygen copper, which is used in a manufacturing method according to a first embodiment of the present invention.
Figure 2:
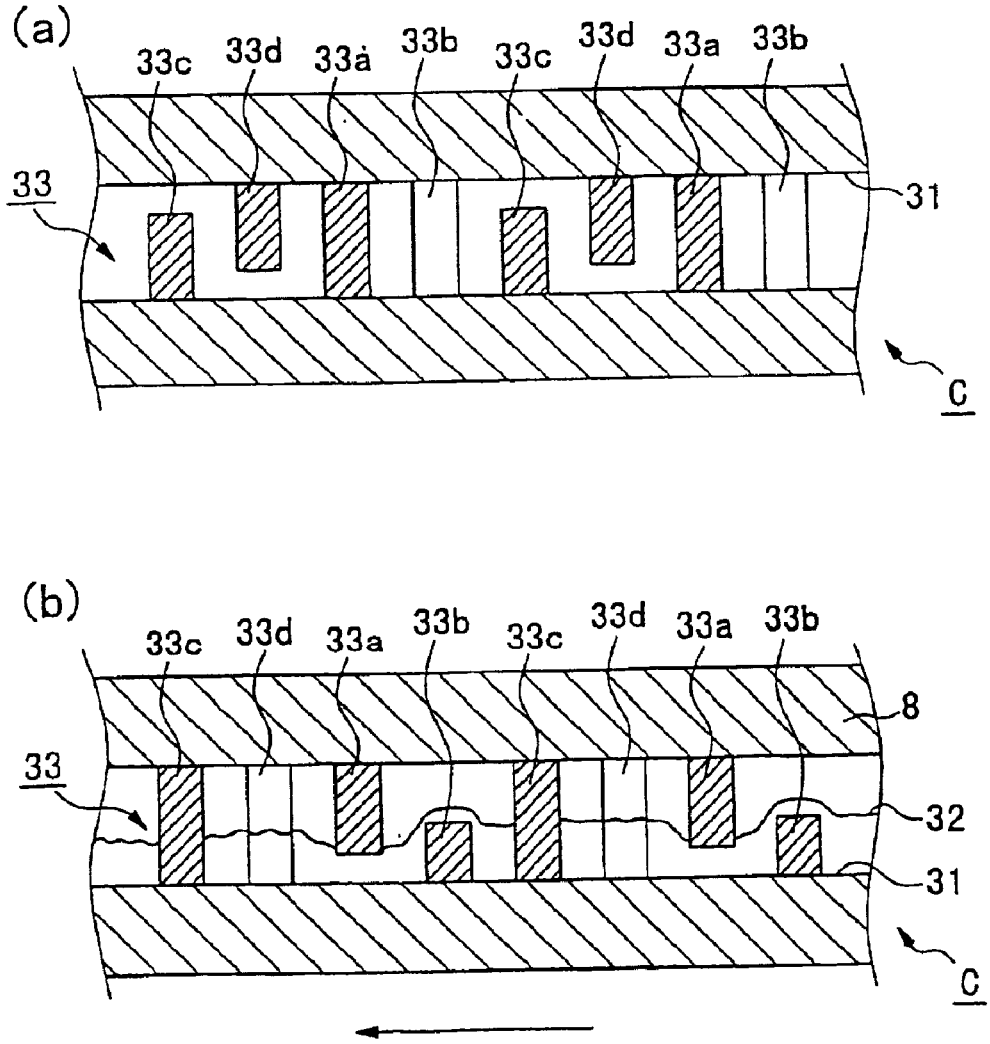
FIG. 2A is an enlarged plan view showing an important portion of a casting trough in FIG. 1.
FIG. 2B is an enlarged side view showing an important portion of the casting trough in FIG. 1.

FIG. 1 is a schematic view showing the structure of an apparatus for manufacturing an ingot of low-oxygen copper, which is used in this embodiment of the present invention, and FIGS. 2A and 2B are enlarged plan and side views, respectively, each showing an important portion in FIG. 1.

An apparatus for manufacturing an ingot of low-oxygen copper (an apparatus for manufacturing low-oxygen copper) 101 is composed of a melting furnace A, a soaking furnace B, a casting trough C, a continuous casting machine D, a cutter E, and a transfer device F.

An apparatus for manufacturing an ingot of low-oxygen copper (an apparatus for manufacturing low-oxygen copper) 101 is composed of a melting furnace A, a holding furnace B, a casting trough C, a continuous casting machine D, a cutter E, and a transfer device F.

The holding furnace B is a furnace for temporarily storing the molten liquid supplied from the melting furnace A and for supplying the molten liquid to the casting trough C while the temperature of the molten liquid is maintained.

The casting trough C seals the molten liquid supplied from the holding furnace B in a non-oxidizing atmosphere and transfers the molten liquid to the tundish 5*a*. As shown in FIG. 2B, the upper surface of a flow path (flow path for molten copper) 31 in the casing trough C is covered by a cover 8, whereby the flow path 31 in the casting trough C is sealed. The non-oxidizing atmosphere is formed by, for example, blowing a mixed gas of nitrogen and carbon monoxide, or an inert gas such as argon, in the casting trough C.

As shown in FIGS. 2A and 2B, the flow path 31 for molten copper in the casting trough C is provided with a stirrer (degasser) 33 for performing a degassing treatment including a dehydrogenating treatment for the molten liquid passing therethrough. The stirrer 33 is composed of dikes 33*a*, 33*b*, 33*c*, and 33*d* so that the molten liquid is vigorously stirred while passing therethrough.

The dikes 33*a* are provided at the upper side of the flow path 31 for the molten copper, that is, at the cover 8. In addition, the dikes 33*b* are provided at the lower side of the flow path 31 for the molten copper, the dikes 33*c* are provided at the left side of the flow path 31 for the molten copper, and the dikes 33*d* are provided at the right side of the dikes 33*c* in the flow path 31 for the molten copper. By the dikes 33*a*, 33*b*, 33*c*, and 33*d* provided in the manner described above, the molten liquid flows up and down, and left to right, toward the direction indicated by the arrow in FIG. 2B so as to be vigorously stirred, whereby a degassing treatment can be performed. In FIG. 2B, reference numeral 32 indicates the surface of the molten liquid.

The dikes 33*c* and 33*d* make the moving distance of the molten liquid longer than the actual flow path 31 for the molten copper, and hence even if the casting trough C is short, the efficiency of the degassing treatment can be improved. In addition, the dikes 33*a* and 33*b* serve to prevent gases in the non-oxidizing atmosphere before and after the degassing treatment from being mixed with each other, and in a manner similar to that, the dikes 33*a* and 33*b* serve to prevent the molten copper before the degassing treatment from being mixed with the molten copper after the degassing treatment.

The stirrer 33 primarily performs a dehydrogenating treatment; however, the stirrer 33 can also drive out the oxygen remaining in the molten liquid by stirring. That is, the dehydrogenating treatment and a second deoxidizing treatment are performed in the degassing treatment. When the dikes 33*a*, 33*b*, 33*c*, and 33*d* are formed of, for example carbon, the deoxidizing treatment can be efficiently performed by the contact of the molten copper with the carbon.

The degassing treatment must be performed in a step of transferring the molten copper after it passes the holding furnace B. The reason for this is that since combustion in a reducing atmosphere or a deoxidizing treatment by using a reducing agent is performed in the holding furnace B in order to manufacture ingots of low-oxygen copper, the concentration of hydrogen in the molten copper is inevitably increased in the holding furnace B in accordance with the equilibrium equation (A) described above.

In addition, the degassing treatment is not preferably performed at the tundish 5*a* located at just in front of the continuous casting machine D. The reason for this is that when the molten liquid is moved so as to be vigorously stirred by, for example, bubbling, the surface of the molten liquid is violently vibrated, a head pressure of the molten liquid flowing from a teeming nozzle (not shown) varies, and as a result the molten copper cannot be fed stably to the continuous casting machine D. In contrast, when the surface of the molten liquid is not violently vibrated, the satisfactory effect of the degassing treatment cannot be obtained. Accordingly, the degassing treatment is preferably performed in the transfer step from the holding furnace B to the tundish 5*a*.

The tundish 5*a* is provided with the teeming nozzle (not shown) at the downstream end of the flow path of the molten liquid so that the molten liquid is supplied from the tundish 5*a* to the continuous casting machine D.

The continuous casting machine D is connected to the holding furnace B via the casting trough C. The continuous casting machine D is a so-called vertical casting machine having a mold 41 and pinch rollers 42, in which, while the molten copper is cooled, the molten copper is drawn downward in an approximately vertical direction so to form cast copper 21*a* having a predetermined cross-sectional shape. The shapes and the locations of the mold 41 and the pinch rollers 42 are optionally selected in accordance with the shape of an ingot 23*a* of low-oxygen copper (low-oxygen copper) obtained as a product. For example, when the ingot 23*a* of low-oxygen copper is formed into a billet having an approximately cylindrical form, the mold 41 having a cylindrical cross-sectional shape and the pinch rollers 42 having shapes corresponding thereto may be used. When a cake having an approximately regular cubic shape is formed, the mold 41 having an approximately rectangular shape and the pinch rollers 42 having the shapes corresponding thereto may be used. In FIG. 1, a cake is shown as an example of the ingot 23*a* of low-oxygen copper.

In this embodiment, a vertical continuous casting machine is used as an example; however, a horizontal continuous casting machine for producing an ingot in the horizontal direction may also be used.

The cutter E is to cut the cast copper 21*a* produced by the continuous casting machine D into a predetermined length. As an example of the cutter E, there may be mentioned a flying saw having a rotary disk blade, although other structures capable of cutting the cast copper 21*a* may also be used.

The transfer device F is composed of a basket 51, an elevator 52, and a conveyor 53. The basket 51 is located approximately right under the continuous casting machine D, receives the ingot 23*a* of low-oxygen copper having a predetermined length formed by the cutter E, and places the ingot 23*a* on the elevator 52. The elevator 52 lifts the ingot 23*a* of low-oxygen copper placed thereon by the basket 51 to the level at which the conveyor 53 is located. The conveyor 53 then transfers the ingot 23*a* of low-oxygen copper lifted up by the elevator 52.

Next, a method for manufacturing an ingot of low-oxygen copper will be described using a manufacturing apparatus 101 having the structure described above.

Combustion is first performed in a reducing atmosphere in the melting furnace A so as to produce molten copper while being deoxidized (step of producing molten copper). The deoxidized molten copper transferred to the casting trough C via the holding furnace B is sealed in a non-oxidizing atmosphere and is then transferred to the tundish 5*a* step of transferring molten copper). Since the concentration of oxygen is inversely proportional to that of hydrogen, the concentration of hydrogen in the molten copper deoxidized in the melting furnace A is increased. The molten copper having a high hydrogen concentration is dehydrogenated by the stirrer 33 while passing through the casting trough C (degassing step). is controlled to 20 ppm or less, and the content of hydrogen is controlled to 1 ppm or less. As a result, the amount of gas evolved in casting is decreased and the generation of holes in the cast copper 21*a* can be suppressed.

In addition, according to the equilibrium equation (A), since the gas concentration in the molten copper is decreased when the partial pressure of steam is decreased, in the case in which the molten copper before processed by dehydrogenation is ideally separated from the dehydrogenated molten copper, the degassing effect can be further improved. The improved degassing effect described above can be realized by, for example, providing the stirrer 33 described above in the step of transferring the molten copper. That is, the stirrer 33 described above also serves to prevent the gases in the atmospheres before and after the degassing treatment from being mixed with each other and serves to prevent the molten copper before the degassing treatment from being mixed with the molten copper after the degassing treatment.

The molten copper transferred from the melting furnace A to the holding furnace B is heated and is then supplied to the continuous casting machine D via the casting trough C and 62 the tundish 5*a*. Subsequently, the molten copper is drawn downward through the mold 41 by the pinch rollers 42, is cooled and solidified, and is then continuously cast so as to produce the cast copper 21*a* (continuous casting step).

The cast copper 21*a* is cut by the cutter E, thereby continuously yielding the ingots 23*a* of low-oxygen copper, each having a predetermined length (cutting step).

The ingots 23*a* of low-oxygen copper obtained by cutting the cast copper 21*a* is transferred by the transfer device F (transfer step). That is, the ingots 23*a* of low-oxygen copper are received in the basket 51 located approximately right under the continuous casting machine D, are lifted to the level at which the conveyor 53 is located by the elevator 52 and is then transferred by the conveyor 53.

In the method for manufacturing the ingots of low-oxygen copper by using the manufacturing apparatus 101 according to this embodiment, the combustion is performed in a reducing atmosphere in the melting furnace A so that the molten copper is deoxidized, and the deoxidized molten copper is sealed in a non-oxidizing atmosphere in the casting trough C and is then transferred to the tundish 5*a*. Since the concentration of oxygen in the molten copper is inversely proportional to that of hydrogen, the concentration of hydrogen in the deoxidized molten copper is increased. However, the molten copper is dehydrogenated by the stirrer 33 used in the subsequent degassing step. Accordingly, without requiring a long moving distance of the molten copper, the concentration of hydrogen, which is increased by a deoxidizing treatment performed by reduction in accordance with the equilibrium equation (A), can be decreased, and hence the generation of holes in the molten copper can be suppressed. As a result, by using a gas furnace in which combustion is performed, the generation of holes can be suppressed in cooling and solidification, and hence mass production of high quality ingots of low-oxygen copper can be continuously performed at lower cost.

In addition, since the degassing step is performed by the stirrer 33 for stirring the molten copper, the dehydrogenating treatment can be forcibly performed in a short period, and hence the dehydrogenating treatment can be efficiently performed by using a simple structure.

Furthermore, when the stirrer 33 is composed of the dikes which meander the flow path for the molten copper, the molten copper is automatically stirred by the flow thereof, and hence the dehydrogenating treatment can be efficiently performed by a simple structure without using an additional agitator or the like. In addition, the operation of the apparatus 101 for manufacturing the ingots of low-oxygen copper can be easily controlled, and hence production costs can be further decreased.

In this connection, the location at which the separation is performed by the stirrer 33 is not limited to one location, and in accordance with the moving distance of the molten copper, a plurality of stirrers may be optionally provided. In addition, the embodiment is not limited to the production of the ingots of low-oxygen copper and may be applied to the production of ingots of low-oxygen copper alloy by adding an appropriate element.

As the stirrer 33, the dikes 33*a*, 33*b*, 33*c*, and 33*d* are respectively provided at the top and bottom, and the right and left, of the flow path 31 for the molten copper; however, the number and the locations of the dikes may be optionally changed in accordance with the length and the width of the casting trough C.

Furthermore, a so-called vertical continuous casting machine D is used in this embodiment; however, a so-called horizontal continuous casting machine may be used instead. In this case, a hoist such as the elevator 52 is not required.

Second Embodiment

Next, a second embodiment will be described with reference to FIGS. 3 and 4. This embodiment relates to a method for manufacturing low-oxygen copper wires.

Figure 3:
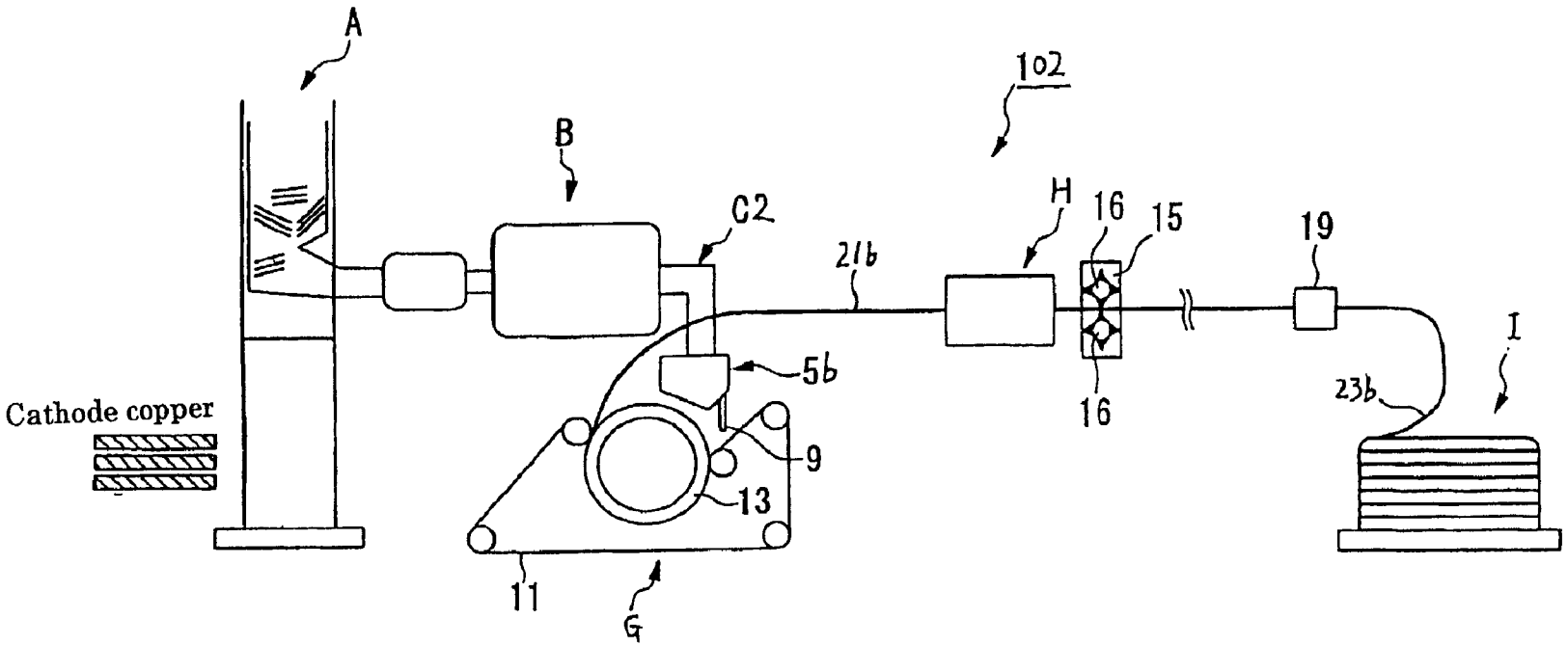
FIG. 3 is a schematic view showing the structure of an apparatus for manufacturing a low-oxygen copper wire, which is used in a manufacturing method according to a second embodiment of the present invention.
Figure 4:
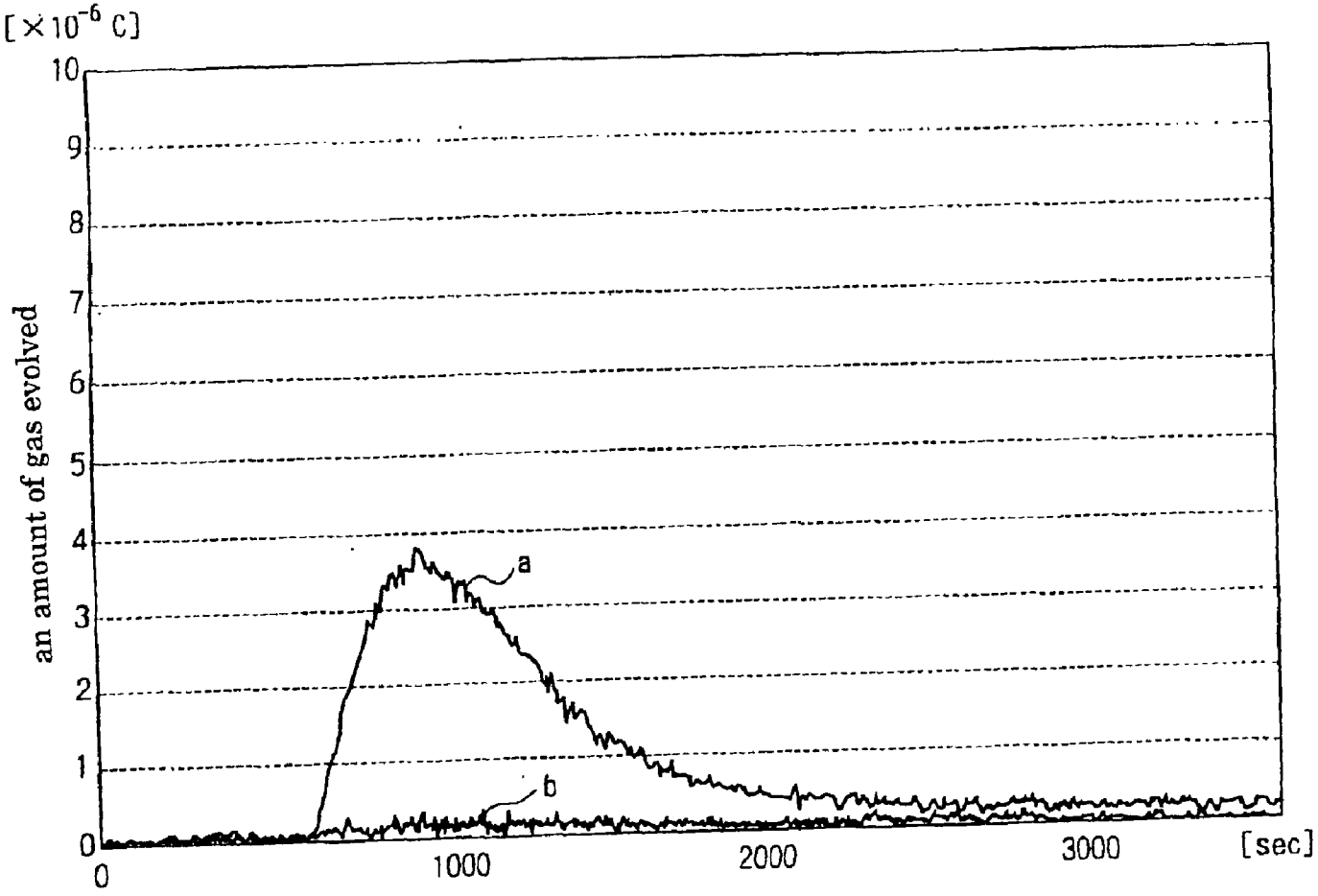
FIG. 4 is a graph showing the characteristics of gas evolution of the low-oxygen copper wire manufactured by the method according to the second embodiment of the present invention compared to those of a low-oxygen copper wire manufactured by a conventional dip forming method.

FIG. 3 is a schematic view showing the structure of an apparatus for manufacturing low-oxygen copper wires, which is used in this embodiment of the present invention. The apparatus for manufacturing low-oxygen copper wires (an apparatus for manufacturing low-oxygen copper) 102 is primarily composed of a melting furnace A, a holding ace B, a casting trough C2, a belt caster type continuous casting machine G, a rolling machine H, and a coiler I.

In this embodiment, since the melting furnace and the holding furnace have the structures equivalent to those described in first embodiment, respectively, the same reference levels of the elements in first embodiment designate the same constituent elements in this embodiment, and detailed descriptions thereof will be omitted.

The casting trough C2 seals the molten liquid in a non-oxidizing atmosphere supplied from the holding furnace B and transfers the sealed molten liquid to a tundish 5*b*. The tundish 5*b* is provided with a teeming nozzle 9 at the end of the flow direction of the molten liquid so that the molten liquid is supplied from the tundish 5*b* to the belt caster continuous casting machine G.

The casting trough C2 and the tundish 5*b* have shapes and the like slightly different from those of first embodiment described above so as to be applied to the production of low-oxygen copper wires; however, the basic structures thereof are approximately equivalent to those in first embodiment, respectively. That is, the casting trough C2 is provided with a stirrer 33 shown in FIGS. 2A and 2B.

The belt caster type continuous casting machine G is connected to the holding furnace B via the casting trough C2. The belt caster type continuous casting machine is composed of an endless belt 11 moving around and a casting wheel 13 rotated by the endless belt 11 which is in contact with a part of the casting wheel 13, in which a cast copper 21*b* is continuously produced. The belt caster type continuous casting machine G is also connected to the rolling machine H.

The rolling machine H rolls the cast copper 21*b* in the form of a bar, supplied from the belt caster type continuous casting machine G, so as to produce low-oxygen copper wires (low-oxygen copper) 23*b*. The rolling machine H is connected to the coiler I via a shear (cutter) 15 and a defect detector 19.

The shear 15, provided with a pair of rotary blades 16, cuts the cast copper 21*b* rolled by the rolling machine H; that is, the shear 15 cuts the low-oxygen copper wire 23*b* into wires having shorter lengths. For example, immediately after the belt caster type continuous casting machine G is started, the internal texture of the cast copper 21*b* is not stable, and hence low-oxygen copper wire 23*b* cannot be produced with stable quality. Accordingly, in the case described above, the low-oxygen copper wire 23*b* supplied from the rolling machine H is sequentially cut by the shear 15 so that the low-oxygen copper wire 23*b* is not transferred to the defect detector 19 and to the coiler I until the quality of the cast copper 21*b* is stabilized. When the quality of the cast copper material 21*b* stabilizes, the rotary blades 16 are separated from each other so as to permit transfer of the low-oxygen copper wire 23*b* to the defect detector 19 and the coiler I.

Next, a method for manufacturing the low-oxygen copper wire will be described, using the apparatus 102 for manufacturing the low-oxygen copper wire having the structure described above.

Combustion is first performed in a reducing atmosphere in the melting furnace A so as to produce molten copper while being deoxidized (step of producing molten copper). The deoxidized molten copper transferred to the casting trough C2 via the holding furnace B is sealed in a non-oxidizing atmosphere and is then transferred to the tundish 5*b* (step of transferring molten copper). Since the concentration of oxygen is inversely proportional to that of hydrogen, the concentration of hydrogen in the molten copper deoxidized in the melting furnace A is increased. The molten copper having a high hydrogen concentration is then dehydrogenated by the stirrer 33 while passing through the casting C2 (degassing step).

According to the steps described above, the content of oxygen in the molten copper is controlled to 20 ppm or less, and the content of hydrogen is controlled to 1 ppm or less. As a result, the amount of gas evolved in casting is decreased, and the generation of holes in the cast copper 21*b* can be suppressed.

In addition, according to the equilibrium equation (A), since the gas concentration in the molten copper is decreased when the partial pressure of steam is decreased, the molten copper which has not been processed by dehydrogenation is ideally separated from the dehydrogenated molten copper, and so the degassing effect can be further improved. The improved degassing effect described above can be realized by, for example, providing the stirrer 33 described above in the step of transferring the molten copper. That is, the stirrer 33 also serves to prevent the gases in the atmospheres before and after the degassing treatment from being mixed with each other and serves to prevent the molten copper before the degassing treatment from being mixed with the molten copper after the degassing treatment.

The molten copper transferred from the melting furnace A to the holding furnace B is heated and is then supplied to the belt caster type continuous casting machine from the teeming nozzle 9 of the tundish 5*b* via the casting trough C2. Subsequently, the molten copper is then continuously cast by the belt caster type continuous casting machine G, thereby yielding cast copper 21*b* at the end thereof (continuous casting step).

The cast copper 21*a* is rolled by the rolling machine H, thereby yielding low-oxygen copper wire 23*b* (low-oxygen copper) having superior surface quality (rolling step). When the low-oxygen copper wire (low-oxygen copper) 23*b* has stable quality, and after defects are detected by the defect detector 19, the low-oxygen copper wire 23*b* is wound around the coiler I while a lubricant oil such as wax, is coated on the wire 23*b*, and the low-oxygen copper wire in wound form is transferred to a subsequent step.

In the method for manufacturing the low-oxygen copper wire described above, since the content of oxygen in the molten copper is controlled to 20 ppm or less, and the content of hydrogen is controlled to 1 ppm or less prior to the steps of casting and rolling, the amount of gas evolved in casting is decreased, the generation of holes in the cast copper 21*b* can be suppressed, and the defects on the surface of the low-oxygen copper wire can be decreased.

In addition, the low-oxygen copper wire manufactured by the method described above has superior characteristics of gas evolution. FIG. 4 shows characteristics of gas evolution of the low-oxygen copper wire manufactured by the method of this embodiment (Curve b) and of a low-oxygen copper wire manufactured by a conventional dip forming method (Curve a). In this figure, the horizontal axis is the time in seconds elapsed from the start of the evaluation, and the vertical axis is an amount of gas evolved. As shown in the figure, the amount of gas evolved from the low-oxygen copper wire manufactured by the method of this embodiment is very small compared to that of the low-oxygen copper wire manufactured by the dip forming method.

When a low-oxygen copper wire or a low-oxygen copper alloy wire, in which an amount of gas evolved therefrom is large, is used under a high vacuum condition or at a high temperature, the surface quality thereof may be degraded due to the generation of blisters on the surface of the wire, or the gas evolved may be discharged outside so as to pollute the environment in some cases. Since the amount of gas evolved from the low-oxygen copper wire manufactured by the method according to this embodiment is very small, the wire may be applied to a particle accelerator operated under a high vacuum condition or to a microwave oven in which a temperature is increased.

In the method for manufacturing the low-oxygen copper wire by using the manufacturing apparatus 102 according to this embodiment, combustion is performed in a reducing atmosphere in the melting furnace A so that the molten copper is deoxidized, and the deoxidized molten copper is sealed in a non-oxidizing atmosphere in the casting trough C2 and is then transferred to the tundish 5*b*. Since the concentration of oxygen in the molten copper is inversely proportional to that of hydrogen, the concentration of hydrogen is increased in this molten copper. However, the molten copper is dehydrogenated by the stirrer 33 used in the subsequent degassing step. Accordingly, without requiring a long moving distance of the molten copper, the concentration of hydrogen, which is increased by a deoxidizing treatment performed by reduction in accordance with the equilibrium equation (A), can be decreased, and hence the generation of holes in the molten copper can be suppressed. As a result, by using a gas furnace in which combustion is performed, the generation of holes can be suppressed in cooling and in solidification, and hence production of high quality, low-oxygen copper wires can be continuously performed at lower cost.

In addition, since the degassing step is performed by the stirrer 33 for stirring the molten copper, the dehydrogenating treatment can be forcibly performed in a short period, and hence the dehydrogenating treatment can be efficiently performed by using a simple structure.

Furthermore, when the stirrer 33 is composed of the dikes which meander the flow path for the molten copper, the molten copper is automatically stirred by the flow thereof, and hence the dehydrogenating treatment can be efficiently performed by a simple structure without using an additional agitator or the like. In addition, the operation of the apparatus 102 for manufacturing the low-oxygen copper wire can be easily controlled.

In this connection, in order to stabilize a temperature of the molten liquid, an electric furnace may be provided between the holding furnace B and the tundish 5*b*.

In addition, an adder for adding an element other than copper to the molten copper may be provided at any location from the end of the casting trough C2 to the end of the tundish 5*b*.

Third Embodiment

Next, a third embodiment will be described with reference to FIGS. 5, and 6A to 6D. This embodiment relates to a method for manufacturing a wire composed of a low-oxygen copper alloy containing silver (Ag).

The inventors of the present invention discovered through intensive research that by adding a small amount of Ag to molten copper, holes generated in the cast copper alloy containing Ag become finely dispersed micro holes, and that the micro holes thus formed disappear in rolling and do not cause any defects. Accordingly, the generation of holes which is harmful to the wire composed of the low-oxygen copper alloy can be suppressed. In the method for adding Ag, there is still another advantage in that a decrease in the conductivity of wire composed of the low-oxygen copper alloy can also be suppressed.

Figure 5:
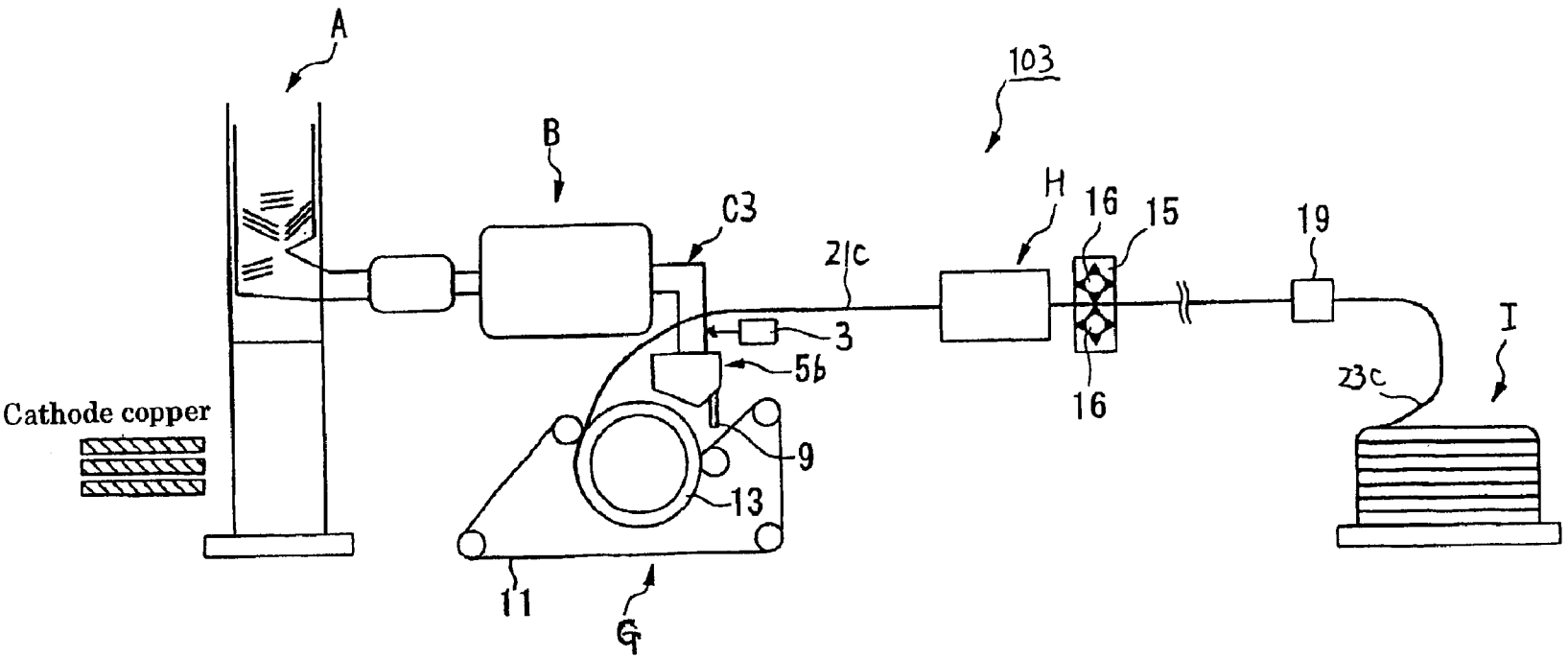
FIG. 5 is a schematic view showing the structure of an apparatus for manufacturing a wire composed of low-oxygen copper alloy, which is used in a manufacturing method according to a third embodiment of the present invention.

FIG. 5 is a schematic view showing the structure of an apparatus for manufacturing the wire composed of the low-oxygen copper alloy which is used in this embodiment of the present invention. In an apparatus 103 for manufacturing wire composed of the low-oxygen copper alloy (an apparatus for manufacturing low-oxygen copper), only the structure of a casting trough differs from that of the apparatus 102 for manufacturing the low-oxygen copper wire in the second embodiment. Accordingly, the same reference labels of the elements in second embodiment designate the same constituent elements in this embodiment, and detailed descriptions thereof will be omitted.

In the apparatus 103 for manufacturing the wire composed of the low-oxygen copper alloy, a casting trough C3 is provided instead of the casting trough C2 in the apparatus 102 for manufacturing the low-oxygen copper wire.

In the vicinity of the end of the casting trough C3, a Ag adder 3 is provided so that Ag can be added to a molten liquid. By this Ag adder 3, Ag can be added to the molten liquid which is deoxidized and dehydrogenated, and by the turbulence of the molten copper in a tundish 5*b*, generated right after the addition of Ag, the Ag and the molten copper are preferably mixed with each other.

In this embodiment, the location at which the Ag adder 3 is provide is not limited to the vicinity of the end of the casting trough C3. That is, so long as the Ag added to the dehydrogenated molten liquid is uniformly diffused therein, the Ag adder 3 may be provided at any location from the end of the casting trough C3 to the end of the tundish 5*b*.

In addition, the structure of the casting trough C3 is equivalent to that of the casting trough C2 except that the Ag adder 3 is provided. That is, the casting trough C3 is provided with a stirrer 33 shown in FIG. 2.

Next, a method for manufacturing the wire composed of the low-oxygen copper alloy will be described, using a manufacturing apparatus 103 having the structure described above.

Combustion is first performed in a reducing atmosphere in a melting furnace A so as to produce molten copper while being deoxidized (step of producing molten copper). The deoxidized molten copper transferred to the casting trough C3 via a tundish furnace B is sealed in a non-oxidizing atmosphere and is then transferred to the tundish 5*b* step of transferring molten copper). Since the concentration of oxygen is inversely proportional to that of hydrogen, the concentration of hydrogen in the molten copper deoxidized in the melting furnace A is increased. The molten copper having a high hydrogen concentration is dehydrogenated by the stirrer 33 while passing through the casting trough C3 (degassing step).

According to the steps described above, the content of oxygen in the molten copper is controlled to 1 to 10 ppm, and the content of hydrogen is controlled to 1 ppm or less. Subsequently, Ag is added to the molten copper, in which the concentrations of oxygen and hydrogen are controlled, by the Ag adder 3 so that the content of the Ag in the molten copper is 0.005 to 0.2 wt % (step of adding Ag).

When the content of Ag is less than 0.005 wt %, the effect of suppressing the defects on the surface of the wire does not occur. In contrast, when the content of Ag is more than 0.2 wt %, the effect of suppressing the defects is not significantly changed compared to that observed when the Ag content is 0.005 to 0.2 wt %, but the strength of the wire composed of the low-oxygen copper alloy is increased, and so rolling, fabrication and the like of the cast copper alloy may not be preferably performed. Accordingly, the content of Ag is preferably controlled in the range described above.

The molten copper containing Ag transferred from the melting furnace A to the holding furnace B is heated and is then supplied to a belt caster type continuous casting machine G via the casting trough C3 and the tundish 5*b*. Subsequently, the molten copper containing Ag is continuously cast by the belt caster type continuous casting machine G, thereby yielding a cast copper alloy 21*c* at the end thereof (continuous casting step).

The cast copper alloy 21*c* is rolled by a rolling machine H, thereby yielding the wire 23*c* composed of the low-oxygen copper alloy (low-oxygen copper) containing a predetermined amount of Ag and having superior surface quality (rolling step). Subsequently, the wire 23*c* is wound around a coiler I.

As described above, since the concentrations of oxygen and hydrogen in the molten copper are controlled, and a predetermined amount of Ag is added to the molten copper prior to the steps of casting and rolling, the amount of gas evolved in casting is decreased, the generation of holes in the cast copper alloy 21*c* can be suppressed and the defects on the surface of the wire composed of the low-oxygen copper alloy can be decreased.

The inspection results of defects on the surface of the wire 23C, composed of the low-oxygen copper alloy obtained by the method using the apparatus 103 described above is shown in FIGS. 6A to 6D. The inspection of defect in this measurement was performed in accordance with a rotational phase type eddy current method using a defect detector for copper wire (RP-7000 manufactured by Estek K.K.)

Figure 6:
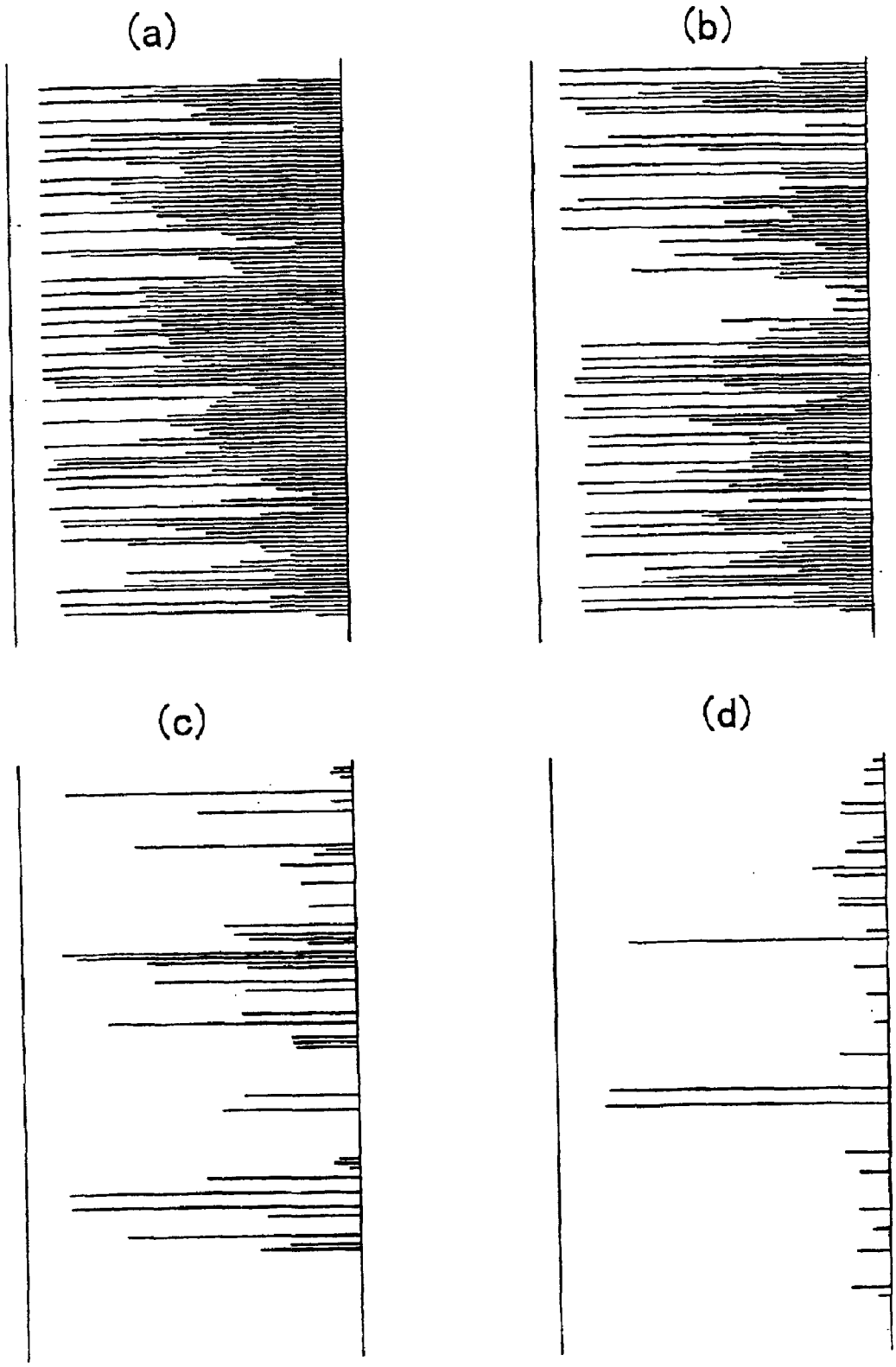
FIGS. 6A to 6D are charts showing defects on the surface of the wire composed of the low-oxygen copper alloy manufactured by the method according to the third embodiment of the present invention.

FIG. 6A shows the result of a wire containing no Ag, FIG. 6B shows the result of a wire containing 0.01 wt % of Ag, FIG. 6C shows the result of a wire containing 0.03 wt % of Ag, and FIG. 6D shows the result of a wire containing 0.05 wt % of Ag. The vertical axis in each figure is time, and the horizontal axis is a voltage (V) of an eddy current generated in accordance with the number and the size of the defects. As shown in FIGS. 6A to 6D, when the content of Ag in the wire 23*c* composed of the low-oxygen copper alloy is higher, that is when the amount of Ag added to the molten copper is increased, the number of defects on the surface of the wire 23*c* is decreased.

When the number of grain boundaries can be increased by adding an element which forms finer crystal grains of copper, the concentration of a gas component per grain boundary is decreased. Accordingly, when a local equilibrium of hydrogen, oxygen and steam in the cast copper alloy 21*c* is considered, an apparent concentration of the gas component in the case described above is significantly decreased compared to the case in which larger grains are formed, and as a result it is believed that large holes are unlikely to be generated.

According to research by the inventors of the present invention, Ag is a preferable element to be added, and when 0.005 wt % or more of Ag is contained, holes formed in the cast copper alloy 21*c* are finely dispersed micro holes, and hence the number of defects on the surface of the wire 23*c* formed by rolling the low-oxygen copper alloy 21*c* can be reduced. In addition, when 0.03 wt % or more of Ag is contained, the defects can be significantly reduced, and when 0.05 wt % or more of Ag is contained, the defects can be further significantly reduced In the method for manufacturing the wire composed of the low-oxygen copper alloy by using the manufacturing apparatus 103 according to this embodiment, combustion is performed in a reducing atmosphere in the melting furnace A so that the molt copper is deoxidized, and the molten copper is then sealed in a non-oxidizing atmosphere in the casting trough C3 and is transferred to the tundish 5*b*. Since the concentration of oxygen in molten copper is inversely proportional to that of hydrogen, the concentration of hydrogen in the deoxidized molten copper is increased. However, the molten copper is dehydrogenated by the stirrer 33 used in the subsequent degassing step. Accordingly, the concentration of hydrogen, which is increased by a deoxidizing treatment performed by reduction accordance with the equilibrium equation (A), is decreased, and hence the generation of holes in solidification can be suppressed. In addition, Ag is added by the Ag adder 3 to the molten copper in which holes are hardly generated by the deoxidizing and the dehydrogenating treatments, whereby finely dispersed micro holes can be formed.

Accordingly, by using the belt caster type continuous casting machine G, long cast copper alloys can be continuously manufactured at lower cost, in which decrease in conductivity is suppressed, and the number of harmful holes is decreased. In addition, even when the degassing step is simplified, a wire composed of low-oxygen copper alloy having excellent surface quality can be manufactured, in which defects on the surface of the wire are significantly reduced. As a result, in order to perform a dehydrogenating treatment, an expensive and specified device, such as a vacuum-degassing device, is not required, and hence the structure of device can be simplified and a wire composed of low-oxygen copper alloy can be manufactured at lower cost.

In addition, since the degassing step is performed by the stirrer 33 for stirring the molten copper, the dehydrogenating treatment can be forcibly performed in a short period, and hence the dehydrogenating treatment can be efficiently performed by using a simple structure.

Furthermore, when the stirrer 33 is composed of the dikes which meander the flow path of the molten copper, the molten copper is automatically stirred by the flow thereof, and hence the dehydrogenating treatment can be efficiently performed by a simpler structure without using an additional agitator or the like. In addition, the operation of the apparatus 103 for manufacturing the wire composed of the low-oxygen copper alloy can be easily controlled.

Since the wire 23*c* composed of the low-oxygen copper alloy contains 0.005 to 0.2 wt % of Ag, a decrease in conductivity can be suppressed, and a high quality wire can be manufactured having a small number of defects on the surface, i.e., superior surface quality.

Fourth Embodiment

Next, a fourth embodiment will be described with reference to FIGS. 7 and 8. This embodiment relates to a method for manufacturing a base low-oxygen copper material containing phosphorus (P) for use in copper plating.

The base low-oxygen copper material is formed into various shapes, such as a bar, a wire and a ball, and is preferably used as, for example, an anode for copper plating forming a wiring pattern on a printed circuit board. That is, a wiring pattern can be preferably formed on a printed circuit board by copper plating, and more preferably, by copper sulfate plating. In copper sulfate plating, a copper material containing phosphorus (low-oxygen copper containing approximately 0.04% of phosphorus) is used as an anode. The phosphorus contained in the copper material promotes smooth dissolution of a copper anode, whereas when an anode for copper plating contains no phosphorus is used, uniform adhesiveness of a plating film is degraded.

Figure 7:
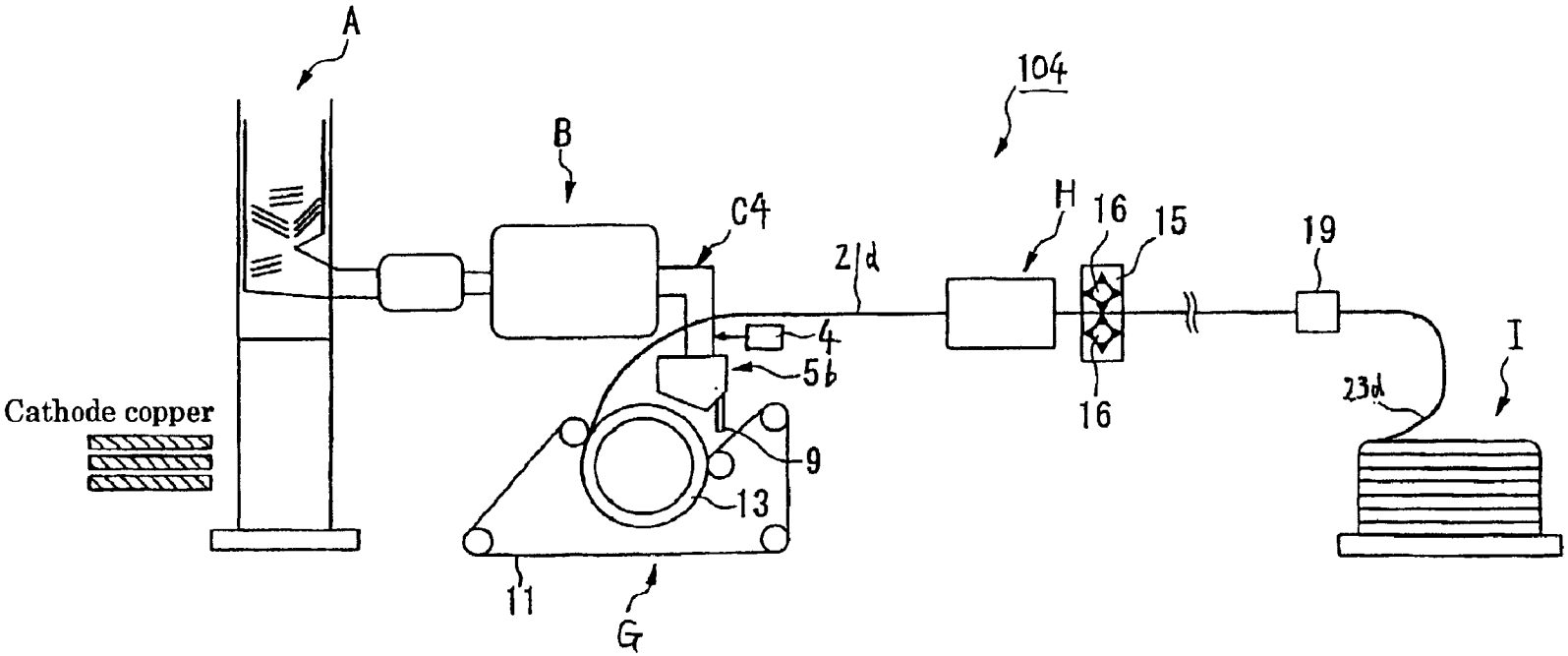
FIG. 7 is a schematic view showing the structure of an apparatus for manufacturing a base copper material containing phosphorus for use in copper plating, which is used in a manufacturing method according to a fourth embodiment of the present invention.

FIG. 7 is a schematic view showing the structure of an apparatus for manufacturing the base copper material containing phosphorus for use in copper plating, which is used in this embodiment of the present invention. In an apparatus (an apparatus for manufacturing low-oxygen copper) 104 for manufacturing the base copper material containing phosphorus for use in copper plating, only the structure of a casting trough differs from that of the apparatus 102 for manufacturing the low-oxygen copper wire in the second embodiment. Accordingly, the same reference labels of the elements in the second embodiment designate the same constituent elements in this embodiment, and detailed descriptions thereof will be omitted.

In the apparatus 104 for manufacturing the base copper material containing phosphorus for use in copper plating, a casting trough C4 is provided instead of the casting trough C2 in the apparatus 102 for manufacturing the low-oxygen copper wire.

In the vicinity of the end of the casting trough C4, a P (phosphorus) adder 4 is provided so that phosphorus can be added to the molten liquid. By this P adder 3, phosphorus can be added to the molten liquid which is deoxidized and dehydrogenated, the reaction between phosphorus and oxygen is prevented, and by the turbulence of the molten copper in a tundish 5*b* generated right after the addition of phosphorus, the phosphorus and the molten copper are preferably mixed with each other.

In this embodiment, the location at which the P adder 4 is provided is not limited to the vicinity of the end of the casting trough C4. That is, so long as the P added to the molten liquid after a dehydrogenating treatment is uniformly diffused therein, the P adder 3 may be provided at any location from the end of the casting trough C4 to the end of th tundish 5*b*.

In addition, the structure of the casting trough C4 is equivalent to that of the casting trough C2 except that the P adder 4 is provided. That is, the casting trough C4 is provided with a stirrer 33 shown in FIG. 2.

Next, a method for manufacturing the base copper material containing phosphorus for use in copper plating will be described, using an apparatus 104 having the structure described above.

Combustion is first performed in a reducing atmosphere in a melting furnace A so as to produce molten copper while being deoxidized (step of producing molten copper). The deoxidized molten copper, transferred to the casting trough C4 via a holding furnace B, is sealed in a non-oxidizing atmosphere and is then transferred to the tundish 5*b* (step of transferring molten copper). Since the concentration of oxygen is inversely proportional to that of hydrogen, the concentration of hydrogen in the molten copper deoxidized in the melting furnace A is increased. The molten copper having a high hydrogen concentration is dehydrogenated by the stirrer 33 while passing through the casting trough C4 (degassing step).

According to the steps described above, the content of oxygen in the molten copper is controlled to 20 ppm or less, and the content of hydrogen is controlled to 1 ppm or less. Subsequently, phosphorus is added by the P adder 4 to the molten copper in which the concentrations of oxygen and hydrogen are controlled, so that the content of the phosphorus in the molten copper is 40 to 1,000 ppm (step of adding P).

In this embodiment, when the concentration of oxygen, the concentration of hydrogen and the content of phosphorus are out of the range described above, the following problems may occur. That is, when the concentration of oxygen is more than 20 ppm in the molten copper, the workability is poor, and cracking may occur in a cast base copper material. When the concentration of hydrogen is more than 1 ppm, the amount of gas evolved is large and cracking may occur in the cast base copper material. When the content of phosphorus is less than 40 ppm, uniform solubility cannot be obtained when the base copper material is used as an anode, and hence the base copper material cannot be a material for forming a copper ball. In addition, when the content of phosphorus is more than 1,000 ppm, workability is degraded.

As described above, since the concentrations of oxygen and hydrogen in the molten copper are controlled, and phosphorus is added to the molten copper prior to the steps of casting and rolling, the amount of gas evolved in casting is decreased, the generation of holes in a cast base copper material 21*d* is suppressed, and the defects on the surface of a wire are decreased.

As described above, after the molten copper transferred from a melting furnace A to a holding furnace B is heated, the molten copper is supplied to a belt caster type continuous casting machine G via the casting trough C4 and the tundish 5*b* and is then cast by the continuous casting machine G, whereby the cast base copper material 21 d can be obtained at the end of the continuous casting machine G. The cast base copper material 21*d* is rolled by a rolling machine H, whereby a base copper material (low-oxygen copper) 23*d* containing a predetermined amount of phosphorus for use in copper plating having superior surface quality is formed. The presence of defects in the base copper material 23*d* containing phosphorus is inspected by a defect detector 19, and the base copper material 23*d* is then wound around a coiler I while coated by a lubricant such as wax. The base copper material 23*d* containing phosphorus is then transferred to another step and is then optionally formed into, for example, copper balls.

In the method for manufacturing the base copper material containing phosphorus by using the manufacturing apparatus 104, according to this embodiment, combustion is performed in a reducing atmosphere in the melting furnace A so that the molten copper is deoxidized, and the deoxidized molten copper is sealed in a non-oxidizing atmosphere in the casting trough C4 and is then transferred to the tundish 5*b*. Since the concentration of oxygen is inversely proportional to that of hydrogen, the concentration of hydrogen in the molten copper is increased. However, the molten copper is dehydrogenated by the stirrer 33 used in the subsequent degassing step. Accordingly, the concentration of hydrogen, which is increased in accordance with the equilibrium equation (A) by a deoxidizing treatment performed by reduction, can be decreased without requiring a long moving distance of the molten copper, and hence the generation of holes in the molten copper can be suppressed. As a result, by using the belt caster type continuous casting machine G, a high quality cast base copper material 21*d* can be continuously manufactured at lower cost, having small number of defects on the surface thereof. In addition, since the amount of gas evolve is small, and the number of defects on the surface can be decreased by suppressing the generation of holes, the cast base copper material 21*d* is not cracked, and hence a base copper material 23*d*, containing phosphorus for use in copper plating and having excellent surface quality can be obtained. In addition, since a cast base copper material 21*d* can be obtained having high flexural strength, cracking which occurs when an anode in the form of a ball or use in copper plating is manufactured can be prevented. Furthermore, since the belt caster type continuous casting machine G is used, hot rolling is performed after casting, and hence the remaining cast texture which is produced when an anode for copper plating is formed by direct casting can be eliminated. In addition, an anode for copper plating having a uniform texture can be obtained by recrystallization. Consequently, mass production of high quality anodes for copper plating can be performed at lower cost.

When the degassing step is performed by the stirrer 33 for stirring the molten copper, the dehydrogenating treatment can be forcibly performed in a short period, and hence the dehydrogenating treatment can be efficiently performed by a simpler structure.

In addition, when the stirrer 33 is composed of the dikes which meander the flow path for the molten copper, the molten copper is automatically stirred by the flow thereof, and as a result, the dehydrogenating treatment can be efficiently performed by a simpler structure without using an additional agitator or the like. Furthermore, the operation of the apparatus 104 for manufacturing the base copper material, containing phosphorus for use in copper plating, can be easily controlled.

In addition to the method described above, a short base copper material 23*e* containing phosphorus for use in copper plating may be directly formed by a cutter having a shear 15. The manufacturing method mentioned above will be described as another example of this embodiment according to the present invention.

In the method described above, an apparatus 104*b* for manufacturing the base copper material 23*e* which is composed of the apparatus 104 described above and an alcohol bath (washing means) 18 provided under the shear 15 is used.

Figure 8:
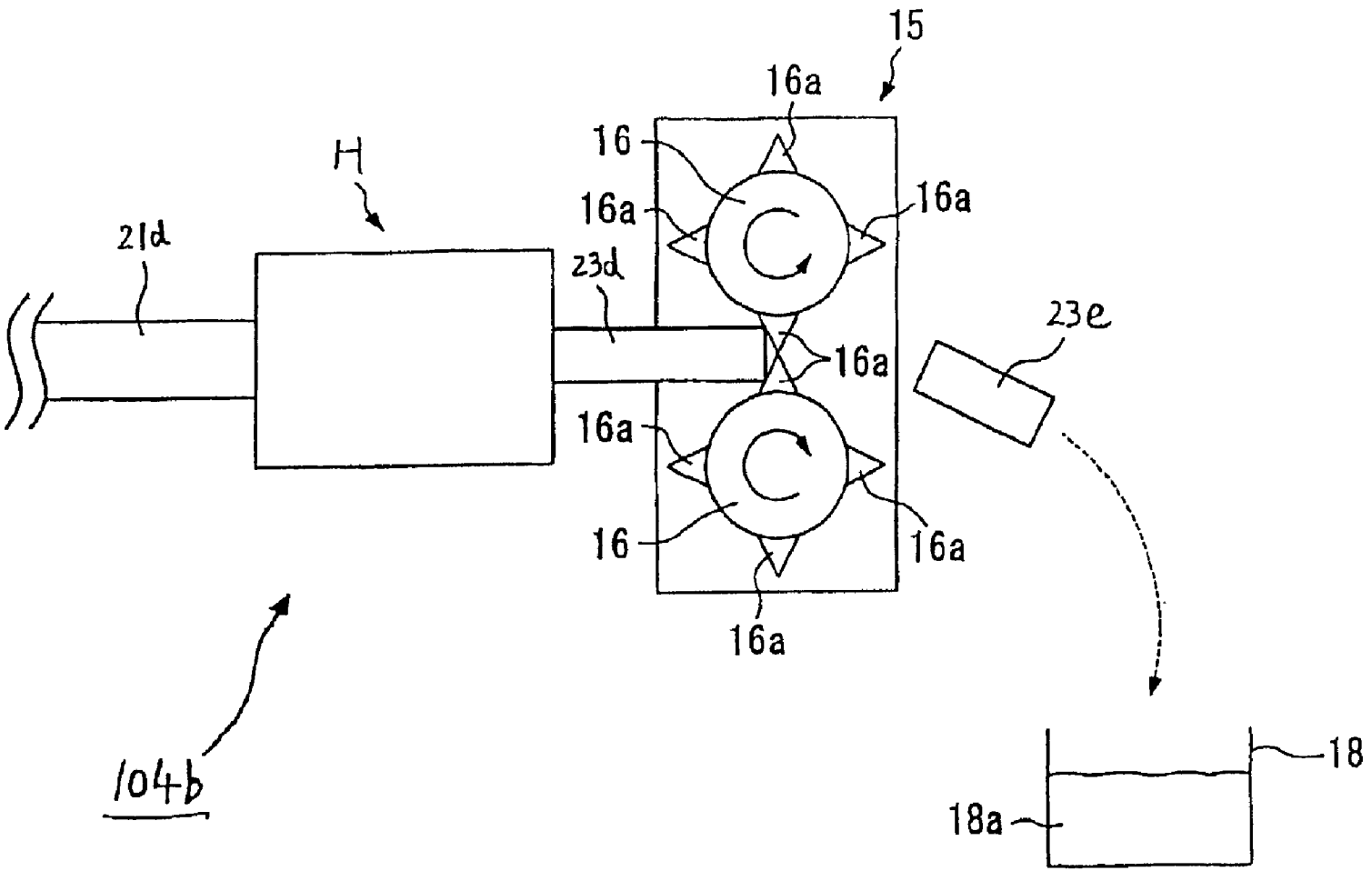
FIG. 8 is a schematic enlarged view showing important portions of an apparatus for manufacturing a base low-oxygen copper material containing phosphorus for use in copper plating, which is used in a manufacturing method according to an example of the fourth embodiment of the present invention.

In the manufacturing method using the apparatus 104*b*, as shown in FIG. 8, the continuous and long base copper material 23*d* ejected from the rolling machine H is sequentially cut into base copper materials 23*e* each having a predetermined length, by a cutting portion 16*a* of a rotary blade 16 of the shear 15 (cutting step). The base copper materials 23*e* are immersed in the alcohol 18*a* contained in the alcohol bath 18, whereby washing is performed by the alcohol 18*a* (washing step). That is, in the method described above, a defect detector 19 and a coiler I are not required.

The base copper material 23*d* ejected from the rolling machine H is still hot, and the surface thereof is oxidized by air, that is a thin oxide film is formed on the surface. However, since the base copper materials 23*e* are immersed in the alcohol 18*a*, the surfaces thereof are washed, and in addition the oxide films formed thereon are reduced, whereby the surface quality, and in particular the brilliance thereof, can be improved. As the alcohol 118*a*, isopropyl alcohol (IPA) is preferable.

In this example, the rotary blades 16 each have four cutting portions 16*a*; however the number of the cutting portions 16*a* can be optionally changed.

As described above, in the manufacturing method using the apparatus 104*b* for manufacturing the base copper material containing phosphorus for use in copper plating, since the short base copper material 23*e* can be directly formed by cutting the base copper material 23*d* into a predetermined length, a step of winding the base copper material 23*d* around the coiler I, which is a necessary step of manufacturing the long base copper material 23*d*, can be eliminated and hence the number of manufacturing steps can be reduced. As a result, for example, copper balls can be easily manufactured at lower cost.

In addition, since a lubricant which is used when the base copper material 23*d* is wound around the coiler I is not required, a risk which may significantly decrease the quality of copper balls, i.e., the quality of anodes for copper plating, can be eliminated, whereby high quality copper balls can be manufactured, and in addition the stability of the quality can be significantly improved.

Furthermore, when the base copper material 23*e* having a short length is washed by using an alcohol 18*a*, such as IPA, a base copper material 23*e* can be obtained having superior surface quality, in particular, superior brilliance.

As a washing solution, acids may also be used in addition to alcohols; however alcohols are preferable due to the easy handling and disposal thereof compared to those of acids.

In the second to fourth embodiments, the belt wheel type continuous casting machine is used as an example of the belt caster type continuous casting machine; however, other belt caster type continuous casting machines may also be used. As a belt caster type continuous casting machine, a twin belt type continuous casting machine having two endless belts may be mentioned.

As has thus been described, according to the method for manufacturing low-oxygen copper of the present invention, a dehydrogenating treatment can be performed without requiring a long moving distance of molten copper, and the generation of holes in solidification is suppressed, whereby high quality low-oxygen copper having superior surface quality can be obtained.

What is claimed is:

1. A method for continuously manufacturing ingots of low-oxygen copper, comprising:

preparing a starting material for the low-oxygen copper;

performing combustion of the starting material in a reducing atmosphere in a melting furnace so as to produce molten copper;

sealing the molten copper in a non-oxidizing atmosphere in a casting trough, the casting trough extending horizontally and having a degasser, the degasser including a plurality of dikes positioned on upper, lower and side surfaces of the casting trough and extending in vertical directions and horizontal directions inside the casting trough such that the molten copper is channeled to flow upward, downward and side to side in the casting trough;

transferring the molten copper horizontally through the degasser to a tundish by using the casting trough;

feeding the dehydrogenated molten copper to a continuous casting machine so as to continuously produce cast copper; and cutting the cast copper into ingots of the low-oxygen copper, each ingot having a predetermined length.

2. A method for continuously manufacturing a low-oxygen copper wire, comprising:

preparing a starting material for low-oxygen copper;

performing combustion of the starting material in a reducing atmosphere a melting furnace so as to produce molten copper;

sealing the molten copper in a non-oxidizing atmosphere in a casting trough, the casting trough extending horizontally and having a degasser, the degasser including a plurality of dikes positioned on upper, lower and side surfaces of the casting trough and extending in vertical directions and horizontal directions inside the casting trough such that the molten copper is channeled to flow upward, downward and side to side in the casting trough;

transferring the molten copper horizontally through the degasser to a tundish by using the casting trough;

feeding the dehydrogenated molten copper to a continuous casting machine so as to continuously produce cast copper; and rolling the cast copper so as to manufacture the low-oxygen copper wire.

3. A method for continuously manufacturing a wire composed of a low-oxygen copper alloy, comprising:

preparing a starting material for low-oxygen copper;

performing combustion of the starting material in a reducing atmosphere in a melting furnace so as to produce molten copper;

sealing the molten copper in a non-oxidizing atmosphere in a casting trough, the trough extending horizontally and having a degasser, the degasser including a plurality of dikes positioned on upper, lower and side surfaces of the casting trough and extending in vertical directions and horizontal directions inside the casting trough such that the molten copper is channeled to flow upward, downward and side to side in the casting trough;

transferring the molten copper horizontally through the degasser to a tundish by using the casting trough;

adding silver to the dehydrogenated molten copper;

feeding the molten copper with the added silver to a continuous casting machine so as to continuously produce a cast copper alloy; and rolling the cast copper alloy so as to manufacture the wire composed of the low-oxygen copper alloy.

4. A method for continuously manufacturing a base low-oxygen copper material containing phosphorus for use in copper plating, comprising:

preparing a starting material for low-oxygen copper;

performing combustion of the starting material in a reducing atmosphere in a melting furnace so as to produce molten copper;

sealing the molten copper in a non-oxidizing atmosphere in a casting trough, the casting trough extending horizontally and having a degasser, the degasser including a plurality of dikes positioned on upper, lower and side surfaces of the casting trough and extending in vertical directions and horizontal directions inside the casting trough such that the molten copper is channeled to flow upward, downward and side to side in the casting trough;

transferring the molten copper horizontally through the degasser to a tundish by using the casting trough;

adding phosphorus to the dehydrogenated molten copper;

feeding the molten copper with the added phosphorus to a continuous casting machine so as to continuously produce a cast base copper material; and rolling the cast base copper material so as to manufacture the base low oxygen copper material containing phosphorus for use in copper plating.

5. A method for manufacturing a base low-oxygen copper material containing phosphorus, according to claim 4, further comprising cutting the base low-oxygen copper material so as to continuously manufacture short base low-oxygen copper materials containing phosphorus for use in copper plating.

6. A method for manufacturing a base low-oxygen copper material containing phosphorus, according to claim 5, further comprising washing the short base low-oxygen copper materials.

* * * * *